United States Patent [19]

Hedstrom

[11] 3,934,682

[45] Jan. 27, 1976

[54] SAFETY DEVICE FOR LIFTS, HOISTS AND LIKE APPARATUS

[76] Inventor: Ture E. Hedstrom, Tjadervagen 35, 141 72 Huddinge, Sweden

[22] Filed: Nov. 5, 1973

[21] Appl. No.: 412,732

[30] Foreign Application Priority Data

Dec. 13, 1972 Sweden ..... 15279/72

[52] U.S. Cl. ..... 187/78; 187/89; 188/189

[51] Int. Cl.[2] ..... B66B 5/18

[58] Field of Search ..... 187/77, 78, 80, 89, 90, 187/19, 73; 188/184, 187, 189; 254/157, 159

[56] References Cited

UNITED STATES PATENTS

| | | | |
|---|---|---|---|
| 2,990,131 | 6/1961 | Carlsson | 254/157 X |
| 3,415,343 | 12/1968 | Svensson | 187/78 X |
| 3,559,773 | 2/1971 | Hock | 188/187 |
| 3,695,399 | 10/1972 | Laing | 187/89 X |
| 3,760,910 | 9/1973 | Koshihara | 254/157 X |

*Primary Examiner*—Evon C. Blunk
*Assistant Examiner*—James L. Rowland
*Attorney, Agent, or Firm*—Eric Y. Munson

[57] ABSTRACT

A safety device for lifts having a lift speed responsive means arranged to be activated when the lift moves at a speed higher than a predetermined speed and when thus activated causes a wheel to rotate, which wheel has a plate against which one or more brake shoes engage under a pressure force.

4 Claims, 4 Drawing Figures

SAFETY DEVICE FOR LIFTS, HOISTS AND LIKE APPARATUS

FIELD OF THE INVENTION

The present invention relates to a safety device for lifts, hoists and like apparatus, and more specifically to such a device which includes means arranged to be activated in response to the speed of travel of the lift, said means being arranged to co-act with a wheel which, upon activation of said means, is caused to rotate at a speed corresponding to the speed of the lift, and said wheel having a plate arranged to co-act with one or more brake pads or the like.

DESCRIPTION OF PRIOR ART

It is previously known to use with safety devices of the type envisaged, a centrifugal device arranged to co-act with a wheel so as to reduce the speed of a lift, for example when a certain predetermined speed of rotation is reached. Different arrangements have been proposed within the art for co-action with the wheel, for the purpose of slowing down the rate of travel of the lift. Thus, according to one such proposal there is placed around the wheel a strap, wire or the like whose one end is attached to the wheel and whose other end is attached to a frame structure via a spring means arranged to absorb all the retardation forces. The disadvantage with such an arrangement, irrespective of whether the spring means, has the form of conventional springs, or of a damping cylinder, is that the braking force is often far too strong, i.e. the braking distance is too short. It is a prime desire within the art that when a lift, hoist or like elevatable apparatus, exceeds a predetermined speed of travel the lift is braked gently at a preferably constant rate of retardation.

OBJECTS OF THE PRESENT INVENTION

One object of the invention is to provide a safety device which fulfills this desire and which comprises but simple and inexpensive components.

As previously mentioned, the present invention specifically relates to lift safety devices having a wheel which is provided with a plate with which one or more braking pads are arranged to co-act. It has been found difficult with such devices, however, to provide for automatic adjustment of the brake pads to a position of engagement with the plate when new brake pads are fitted to the safety device or when the brake pads wear during use.

Another object of the invention is therefore to provide a practical and simple solution of this problem.

Accordingly, the safety device of the present invention is mainly characterized in that the plate is arranged for rotation around a part firmly attached to a frame structure upon activation of the lift speed responsive means.

BRIEF DESCRIPTION OF THE DRAWINGS

So that the invention may be better understood and other features thereof may be made apparent, an embodiment of the invention will now be described with reference to the accompanying drawings, in which.

DESCRIPTION OF THE PREFERRED EMBODIMENTS

Figure 1:
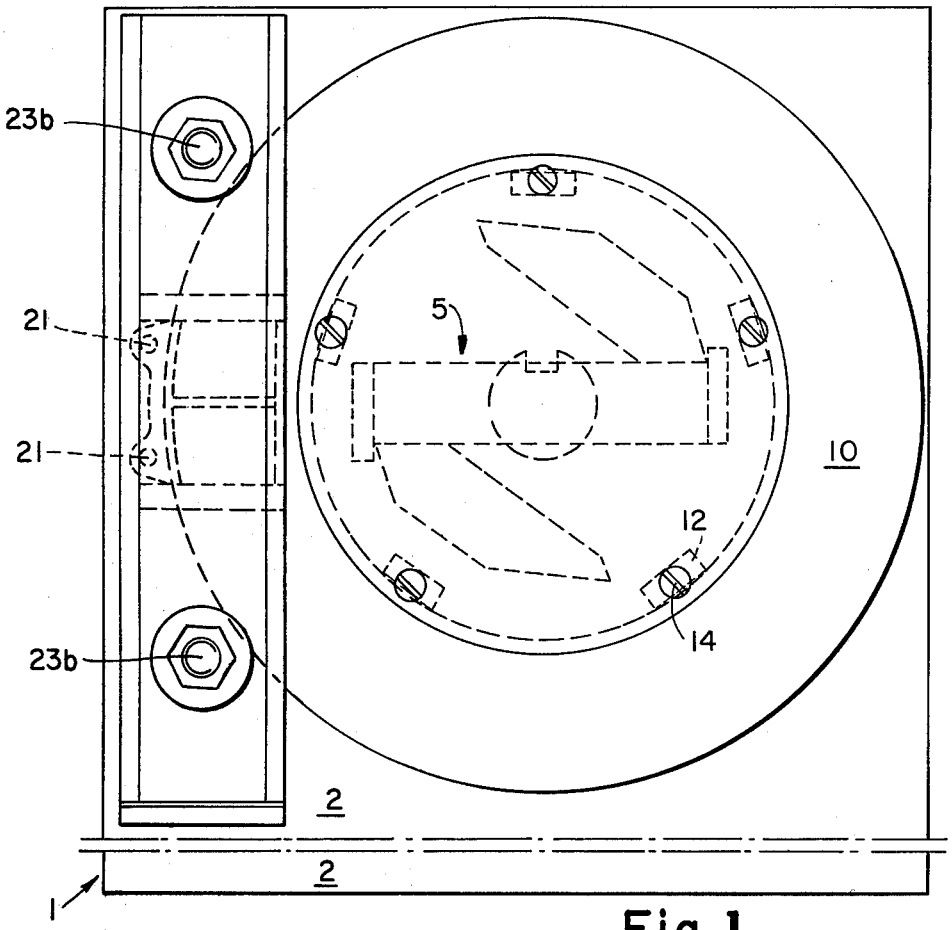
FIG. 1 is a side view of the safety device according to the invention.

Thus, the accompanying drawings show an embodiment of a safety device constructed in accordance with the invention for lifts, hoists and like apparatus. The safety device is generally identified in the drawings by the reference numeral 1 and is mounted on the lift, hoist or like apparatus by conventional attachment means not shown. With the exemplary embodiment, the safety device includes a plate 2 which is fixed to the lift by means of bolts or any other appropriate securing means. Since the lift does not constitute any part of the invention, it is not shown in the drawing.

Extending through the plate 2 is a shaft 3 which on one side of the plate supports a toothed wheel or pinion wheel 4 arranged to co-act with a rack (not shown) to impart upward and downward movement of the lift. It will be readily perceived that the pinion 4 can be replaced with other means equally as suitable for achieving the intended function, although such means must be connected to the lift in a manner such that rotation of said means is dependent on the speed at which the lift travels.

In the embodiment shown, the shaft 3 extends between the pinion wheel 4 and a centrifugal device 5, which latter will be hereinafter described with reference to FIG. 3. The plate 2 is securely joined to a sleeve 6 by means of a weld joint 29. The sleeve 6 is provided with a first bearing 7 and a second bearing 8 for the shaft 3, thereby to position the shaft 3 centrally of the sleeve 6. The sleeve 6 has a bearing surface **6*a* arranged to co-act with a sleeve 9, the sleeve 9 being arranged for rotation and axial displacement on said surface 6*a*. Co-acting with the sleeve 9 is a further plate 10 which extends radially outwards from the shaft 3 in the vicinity of the bearing 8 and which supports a tube 11 arranged concentrically in relation to the shaft 3. With the illustrated embodiment the tube 11 has arranged on the inside thereof stop means 12 for the centrifugal device 5, the stop means 12 also serving to retain a further plate 13 covering the centrifugal device 5. As shown in the drawing, the plate 13 is also secured by means of a number of screws 14**.

A first brake pad 15 is securely fixed to a carrier 16 which is attached to a beam 18 by means of a number of screws 17. The beam 18 is firmly welded to the plate 2, as shown at **18*a*. A second brake pad 19 is securely fixed to a carrier 20 by known means, which in turn is attached to a beam 22 by means of screws 21. As will be seen from the drawing, the brake pads 15, 19 are placed on opposite sides of the plate 10 and are arranged to be urged towards each other by means of a pressure device 23, comprising a bolt 23*a* extending through the plate 2, the beam 18 and the beam 22 and arranged to be tensioned by means of nuts 23*b*, to enable the required pressure of the brake pads against the plate 10 to be set. Arranged between the nuts 23*b* and the beam 22 is a number of springs 23*c*. With the shown embodiment, two bolts are considered sufficient to ensure that the brake pads 15, 19 bear against the plate 10** at the desired pressure.

Figure 3:
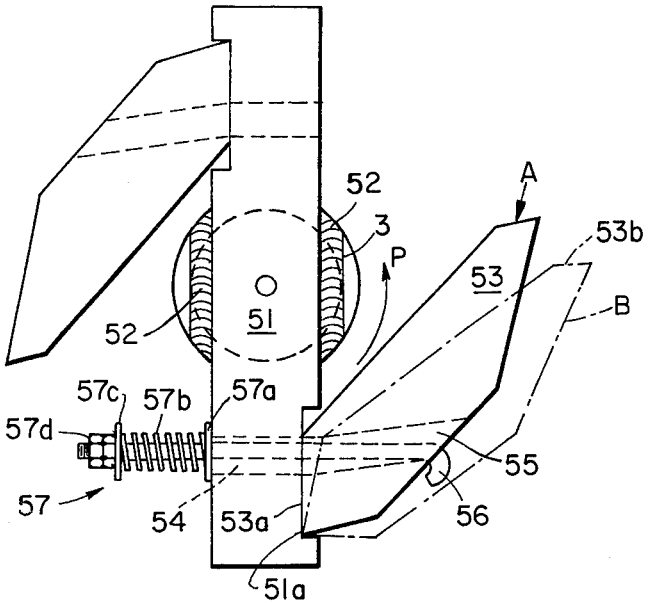
FIG. 3 shows in planview a proposed embodiment of a centrifugal device arranged to co-act with the safety device of the present invention.

FIG. 3 shows the centrifugal device 5 in side view. As will be seen from the drawing, the shaft 3 co-acts with an arm 51 and is joined thereto by means of two welds 52. Attached to the arm 51, in the vicinity of the ends thereof are two wing arms 53. It should be mentioned here, however, that although two wing arms have been shown, the device will operate satisfactorily with only one such arm. Each wing arm 53 has at its end close to the arm 51 a support surface 53*a* which is arranged to be accommodated in a support means 51*a* on the arm 51, the support means 51*a* with the shown embodiment having the form of a recess in the arm 51.

Extending through the arm 51 is a hole 54, the wing arm 53 being provided with a similar hole 55. A hook 56 extends through the hole 55 and the hole 54 in arm 51 and is arranged to co-act at one end with the wing arm 53. Arranged at the other end of the hook 56 is a spring means 57. The spring means 57 comprises a spring 57*b* arranged between two plates 57*a* and 57*c*. Co-acting with the washer 57*c* is a nut 57*d*, by means of which the force with which the wing arm 53 is held against the arm 51 can be regulated, as can also the critical value of the centrifugal device, i.e. the value at which the rotary speed of the arm 51 is such that the wing arm 53 falls out from the position A shown in full lines to the position B shown in ghost lines. In position B, the surface 53*b* on the wing arm 53 is arranged to engage stop means 12. As will be apparent from the aforegoing, the shaft 3 will rotate at a speed dependent on the speed at which the lift moves, the arm 51 rotating in the direction of arrow P.

Figure 2:
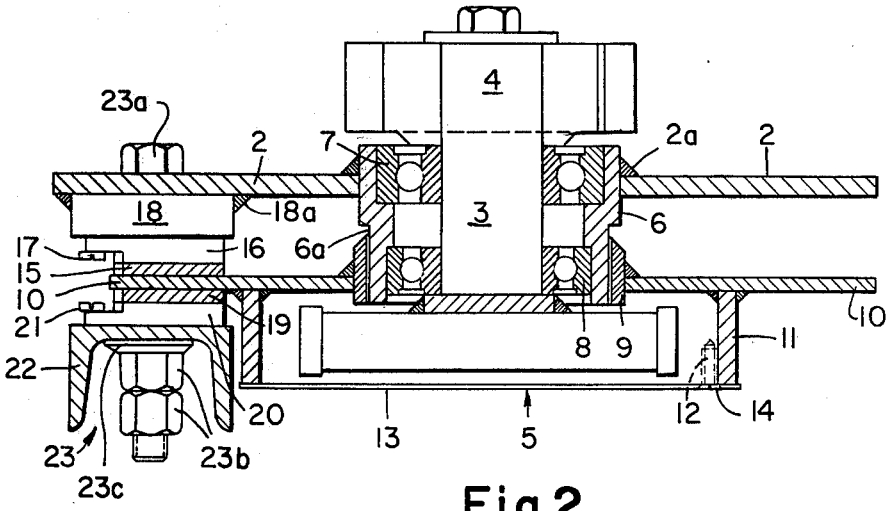
FIG. 2 is a cross-sectional view of the safety device shown in FIG. 1.
Figure 4:
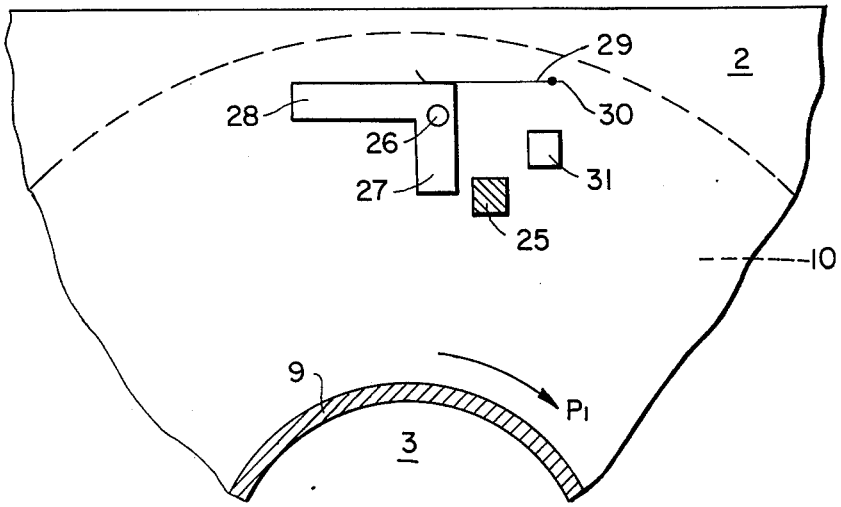
FIG. 4 shows a suitable embodiment of a means for limiting the extent to which the plate can rotate.

FIG. 4 illustrates means for restricting the extent to which the plate 10 can be rotated. Securely arranged on the plate 10 is a stop means 25. The stop means is not shown in FIG. 2, but may be located on the other side of plate 10 in relation to the tube 11. The plate 10 is only shown by dash lines in FIG. 4 to facilitate illustration of the rotary movement restricting means. It is assumed that the plate 10 rotates in the direction of arrow P1. Thus, when the centrifugal device 5 is caused to co-act with the stop means 12, the plate 10 will be rotated. Securely mounted to the plate 2 is a pivot pin 26 around which an L-shaped member is arranged to pivot. The L-shaped member has a first leg 27 and a second leg 28 and is held in its desired position by means of a spring 29, one portion 30 of which spring is securely attached to the plate 10 and the free end of which lies against the L-shaped member.

The means for restricting the extent to which the plate 10 can be rotated operates in the following manner. When the plate 10 is rotated in the direction of arrow P1, the stop 25 rotate with the rotation of the plate since the stop is securely attached thereto. When the stop 25 has moved one revolution it will impinge against the portion 27 of the L-shaped member causing the portion 27 to be rotated counter clockwise around the pivot pin 26 and the portion 28 to point down towards the shaft 3. The arm 27 moves passed the stop 31. When the stop 25 has completed another revolution, the stop 25 will co-act with the arm 28 and move the arm against the stop 31. Thus, the safety device will definitely stop after two revolutions of the plate 10. If it is desired to stop the device after only one revolution of the plate 10, the arm 28 may be set manually to the position in which it points towards the shaft 3.

The invention operates in the following manner. The safety device is coupled to a rack for moving the lift by means of the pinion wheel 4. When the shaft 3 rotates at a speed which exceeds a predetermined value, namely the value determined by the tension in the spring 57*b* of the centrifugal device 5, the wing arm 53 co-acting with the arm 51 is moved out into engagement with a stop 12, the stop in turn causing the plate 10 to rotate. As heretofore mentioned, the brake pads 15, 19 press against the plate 10 with a predetermined force which is selected according to the desired retardation, and the brake pads 15, 19 thus stop the lift. When the lift has stopped, the wing arm 53 remains in engagement with the stop means 12 as a result of the friction between the surface 53*b* and the stop means 12. Should, for some reason, the brake shoes be inoperative or fail to operate with the desired effect, the invention provides a further stop means which causes the plate 10 to stop after an alternative two revolutions.

The invention is not restricted to the described and illustrated embodiments, but can be modified within the scope of the accompanying claims.

For example, the means for restricting the rotation of plate 10 is shown to co-act with a member 31 on the member 2. As an alternative, it is possible to give the arm 28 a length such that the arm engages the sleeve 6 or the member 9.

I claim:

1. A safety device for braking a hoist and the like to a stop when its downward movement in a frame structure reaches a predetermined rate of descent, comprising:

a. a plate member fixed to the frame structure of said hoist having a sleeve member within which a shaft is journalled to rotate with the movement of the hoist;

b. a brake disc mounted to rotate about said sleeve in frictional engagement with stationary friction means effective to brake the descending movement of the hoist;

c. centrifugal means connected to said shaft and responsive to the rotational speed thereof to engage and rotate said brake disc when the rotation of the shaft reaches a predetermined velocity;

d. means carried by said plate member mounted to co-act with means on said brake disc to stop the rotation thereof after a predetermined number of revolutions;

e. said rotation stopping means comprising a spring biased rocker arm pivotally mounted on said plate member and an impingement member carried by said brake disc adapted to engage and move said rocker arm against a stop member carried by said plate upon completion of the predetermined number of revolutions.

2. A safety device according to claim 1 in which said stationary friction means comprise a pair of brake pads disposed on opposite sides of said brake disc and adjustable tensioning means for maintaining said brake pads in engagement with said brake disc under a predetermined pressure.

3. A safety device according to claim 2, in which said adjustable tensioning means comprise bolts and associated nuts, which bolts extend through said plate, and an oppositely disposed beam member, one of the brake pads being connected to said plate member, the other brake pad being connected to the beam member.

4. A safety device according to claim 1, in which said centrifugal means comprise an arm connected to said shaft to rotate therewith free of said brake disc, at least one wing member having one end thereof pivoted to said arm to rotate therewith and to swing radially outward therefrom under the effect of centrifugal force at a predetermined rotational speed of said shaft into engagement with a stop member carried by said brake disc.

* * * * *